US010273728B2

(12) United States Patent
Nam

(10) Patent No.: US 10,273,728 B2
(45) Date of Patent: Apr. 30, 2019

(54) DOOR OPENING PREVENTION DEVICE IN BROADSIDE COLLISION OF VEHICLE

(71) Applicant: Hyundai Motor Company, Seoul (KR)

(72) Inventor: Jin Woo Nam, Seoul (KR)

(73) Assignee: Hyundai Motor Company, Seoul (KR)

( * ) Notice: Subject to any disclaimer, the term of this patent is extended or adjusted under 35 U.S.C. 154(b) by 1132 days.

(21) Appl. No.: 14/526,270

(22) Filed: Oct. 28, 2014

(65) Prior Publication Data

US 2015/0167357 A1 Jun. 18, 2015

(30) Foreign Application Priority Data

Dec. 13, 2013 (KR) ..... 10-2013-0155092

(51) Int. Cl.
*E05B 77/04* (2014.01)
*E05B 85/24* (2014.01)
*E05B 77/06* (2014.01)

(52) U.S. Cl.
CPC ..... *E05B 85/243* (2013.01); *E05B 77/06* (2013.01); *Y10T 292/108* (2015.04)

(58) Field of Classification Search
CPC ..... E05B 85/243; E05B 77/06; Y10T 292/108
See application file for complete search history.

(56) References Cited

U.S. PATENT DOCUMENTS 4,909,571 A * 3/1990 Vidwans ..... B60N 2/433 297/378.11
4,988,134 A * 1/1991 Vidwans ..... B60N 2/433 292/198
6,802,550 B1 * 10/2004 Griggs, Jr. ..... B60R 7/04 296/24.34
9,322,198 B2 * 4/2016 Kovie ..... E05B 77/06
9,637,956 B2 * 5/2017 Niegeloh ..... E05B 85/16

FOREIGN PATENT DOCUMENTS

| | | |
|---|---|---|
| JP | 2010-275734 A | 12/2010 |
| KR | 10-2004-0065501 | 7/2004 |
| KR | 10-0747227 | 8/2007 |
| KR | 10-0868420 | 11/2008 |
| KR | 10-0897693 | 5/2009 |
| KR | 10-2009-0062866 | 6/2009 |

(Continued)

*Primary Examiner* — Kristina R Fulton
*Assistant Examiner* — Thomas L Neubauer
(74) *Attorney, Agent, or Firm* — Morgan, Lewis & Bockius LLP

(57) ABSTRACT

A door opening prevention device in a broadside collision of a vehicle, having a latch assembly which locks and unlocks a door side striker in conjunction with an operation of an outside handle when the outside handle may be operated, may include a balance weight which may be rotatably coupled to a side surface of a claw disposed in the latch assembly, wherein the balance weight may be pivotable downward by inertia in the broadside collision of the vehicle, and a striker locking lever slidably engaged to the side surface of the claw and elastically biased upwards, wherein the striker locking lever may be fitted between the side surface of the claw and the door side striker to jam the claw and the door side striker while being moved in a down direction by contact with the balance weight by the inertia in the broadside collision of the vehicle.

9 Claims, 5 Drawing Sheets

(56) References Cited

FOREIGN PATENT DOCUMENTS

| | | |
|---|---|---|
| KR | 10-0916425 | 9/2009 |
| KR | 10-0957101 | 5/2010 |
| KR | 10-0957103 | 5/2010 |
| KR | 10-1144044 | 5/2012 |
| KR | 10-1209680 | 12/2012 |

* cited by examiner

DOOR OPENING PREVENTION DEVICE IN BROADSIDE COLLISION OF VEHICLE

CROSS-REFERENCE TO RELATED APPLICATION

The present application claims priority to Korean Patent Application No. 10-2013-0155092 filed on Dec. 13, 2013, the entire contents of which is incorporated herein for all purposes by this reference.

BACKGROUND OF THE INVENTION

Field of the Invention

The present invention relates to a door opening prevention device in a broadside collision of a vehicle, and more particularly, to a device which restricts a door outside handle so as to prevent a door from being opened in a broadside collision of a vehicle.

Description of Related Art

In general, when a door is opened in a broadside collision of a vehicle, an occupant catapults out of a vehicle and may be greatly injured.

In consideration of the aforementioned situation, a balance weight, which may give inertial resistance force to a door outside handle, is applied, so as to resolve the problem of the possibility of the door being opened during a broadside collision of a vehicle.

Typically, according to a mechanism for opening the door in a broadside collision of a vehicle, the door outside handle is pulled by inertial force that is generated when a collision occurs, and thereby, a door latch releases restriction of a striker such that the door is opened.

In order to prepare for the aforementioned problem, the balance weight is connected to a lever of the outside handle so as to prevent the outside handle from being opened due to inertial force that is generated when a collision occurs.

For example, as illustrated in FIG. 5, an outside handle lever 120, which is rotatable about a hinge shaft 110 in conjunction with an outside handle 100, is installed inside the outside handle 100, and a balance weight 130 is formed on the outside handle lever 120.

Here, a reference numeral 140, which has not been described, refers to a return spring for restoring the outside handle lever.

Therefore, immediately after a broadside collision of a vehicle, the outside handle is pulled by inertial force of the vehicle while receiving force that is directed toward the exterior of the vehicle, and when the outside handle is pulled by the positive inertia, the door may be opened as the outside handle lever is rotated.

In consideration of the aforementioned situation, the balance weight is mounted on the hinge shaft of the outside handle lever so as to offset the inertial force of the outside handle, thereby preventing the door from being opened.

However, the door opening prevention device in the related art has the following drawbacks.

Firstly, costs and weights are increased due to unnecessary components.

That is, the balance weight is present on the outside handle lever in order to merely prevent the door from being opened in a broadside collision, and needs to have a size, which corresponds to a handle size (weight), in order to provide inertial force that is sufficient for preventing the door from being opened in a broadside collision of a vehicle.

Accordingly, burdens of costs and weights are increased.

Secondly, a problem with the layout between the balance weight and peripheral components occurs.

That is, when an occupant pulls the handle and gets in an interior room, the outside handle lever is rotated and moved in a direction in which a gap with a glass becomes insufficient.

There is a disadvantage in terms of the layout in that if a sufficient space is not secured when performing an initial design in consideration of the aforementioned situation, a serious problem may occur in the future.

Thirdly, there is a problem in that the balance weight needs to be newly manufactured and tuned in accordance with the type of vehicle that is being developed.

That is, because sizes and designs of the handles are different for each type of vehicle, various balance weights also need to be applied for each type of vehicle, and thereby, various molds need to be manufactured for each type of vehicle, and tests need to be repeatedly performed over a number of times and to be tuned.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a door opening prevention device in a broadside collision of a vehicle which has a striker locking lever which is operated by inertia at a claw side, which catches a door striker, and restricts the striker, and implements a new type of door opening prevention structure in which a door latch instead of an outside handle may restrict the striker in a broadside collision of a vehicle, such that a weight balance applied to the existing outside handle may be omitted, thereby reducing costs and weights, and providing advantages in terms of layout.

In order to achieve the aforementioned object, the door opening prevention device in a broadside collision of a vehicle, which is provided in the present invention, has the following features.

In an aspect of the present invention, a door opening prevention device in a broadside collision of a vehicle, having a latch assembly which locks and unlocks a door side striker in conjunction with an operation of an outside handle when the outside handle is operated, may include a balance weight which is rotatably coupled to a side surface of a claw disposed in the latch assembly, wherein the balance weight is pivotable downward by inertia in the broadside collision of the vehicle, and a striker locking lever slidably engaged to the side surface of the claw and elastically biased upwards, wherein the striker locking lever is fitted between the side surface of the claw and the door side striker to jam the claw and the door side striker while being moved in a down direction by contact with the balance weight by the inertia in the broadside collision of the vehicle.

The balance weight may have a lower end which is rotatably supported by a hinge shaft that is formed on the side surface of the claw, and the balance weight receives restoring force of a return spring which is installed on the hinge shaft and connects the side surface of the claw and the balance weight, to maintain a vertical posture.

An upper portion of the balance weight is formed as a mass portion that is heavier than a remaining portion of the balance weight.

The striker locking lever is resiliently supported upward by a lever spring that may have an end supported at the side surface of the claw.

The striker locking lever may include a lower end portion extending from an upper end portion of the striker locking lever in a tapered shape such that a cross-sectional area of the striker locking lever gradually becomes smaller from the upper end portion toward the lower end portion.

The striker locking lever may further include a protrusion extending from the upper end portion, and a lever spring that may have an end supported at the side surface of the claw is positioned under the protrusion to elastically support the striker locking lever upwards.

The door opening prevention device may further include a bracket to slidably receive the striker locking lever therein.

The door opening prevention device in a broadside collision of a vehicle, which is provided in the present invention, may have the following advantages.

Firstly, the balance weight, which is much smaller than a balance weight that is applied to the existing outside handle, is applied, thereby reducing weights as well as costs.

Secondly, the door latch is commonly applied to various types of vehicles because the door latch is not a component for an external appearance, and thereby, problems of newly manufacturing components and tuning the components over a number of times may be resolved even though the door latch, which is once verified, is applied to another vehicle, thereby reducing working hours for tests and costs for tests.

Thirdly, the striker locking lever and the balance weight are installed in the latch assembly, and thus it is not necessary to consider interference with a door glass, thereby providing an advantage in terms of layout design.

Other aspects and preferred embodiments of the invention are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
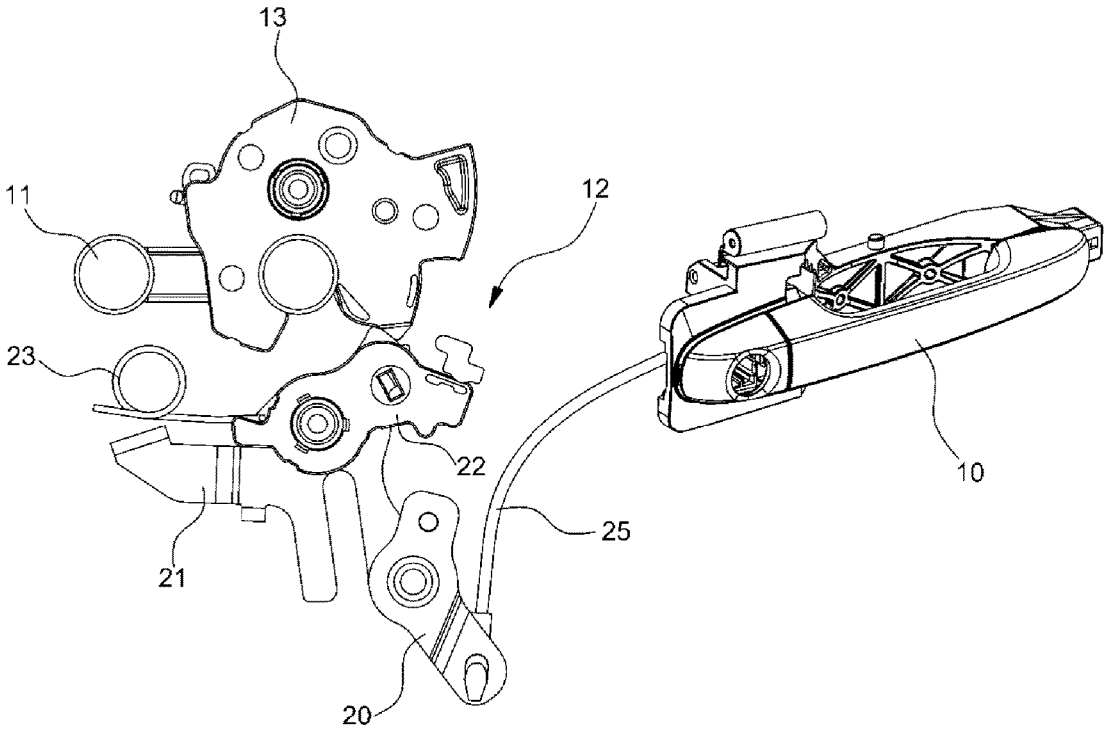
FIG. 1 is a front view illustrating a latch assembly to which a door opening prevention device is installed according to an exemplary embodiment of the present invention.

Reference numerals set forth in the Drawings includes reference to the following elements as further discussed below.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Hereinafter, an exemplary embodiment of the present invention will be described with reference to the accompanying drawings so that those skilled in the Field of the Invention to which the present invention pertains may carry out the exemplary embodiment.

FIG. 1 is a front view illustrating a latch assembly to which a door opening prevention device is installed according to an exemplary embodiment of the present invention.

As illustrated in FIG. 1, the latch assembly includes an outside handle opening lever 20 which is connected to an outside handle 10, which is disposed at a door, through a cable 25 and is rotated by handle operational force, a pawl lever 21 and a pawl 22 which are rotated in conjunction with rotation of the outside handle opening lever 20 in a direction opposite to a rotation direction of the outside handle opening lever 20, and are resiliently supported by a pawl spring 23, a claw 13 which has one end that is caught by the pawl lever 21 side so as to maintain a positive posture (a posture which may catch a striker), and is rotatable when the striker 11 moves and pulls the claw 13 in a case in which the claw 13 is disengaged from the pawl lever 21 side, a claw spring 24 which maintains the positive posture of the claw 13, and the like.

Therefore, when a user pulls the outside handle 10 in order to get in a vehicle, operations such as rotation of the outside handle opening lever 20→rotations of the pawl lever 21 and the pawl 22→disengagement between the pawl lever 21 and the claw 13 are performed, the door begins to open, the striker 11 is also pulled at the same time so as to escape while pushing the claw 13, and as a result, the user may open the door.

Here, because constituent components of the latch assembly and operational relationships between the constituent components are identical to those of a latch assembly in the related art, a more specific description thereof will be omitted.

Further, in this latch assembly, the door opening prevention device of the present invention, that is, the door opening prevention device which is configured by a combination of a striker locking lever, a balance weight, and the like, is provided at the claw 13 side of the latch assembly, and prevents the door from being opened in a broadside collision of a vehicle by using a jamming structure with the striker side.

Figure 2B:
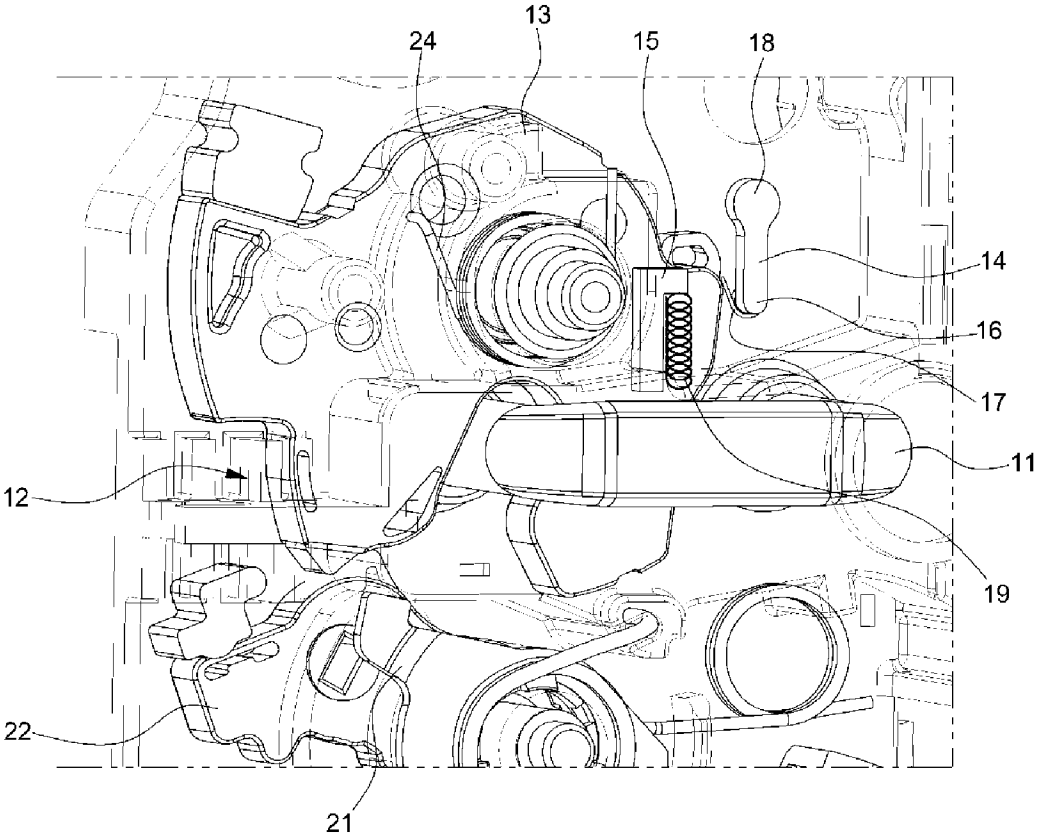
FIGS. 2A and 2B are back perspective views illustrating the door opening prevention device according to an exemplary embodiment of the present invention.
Figure 2A:
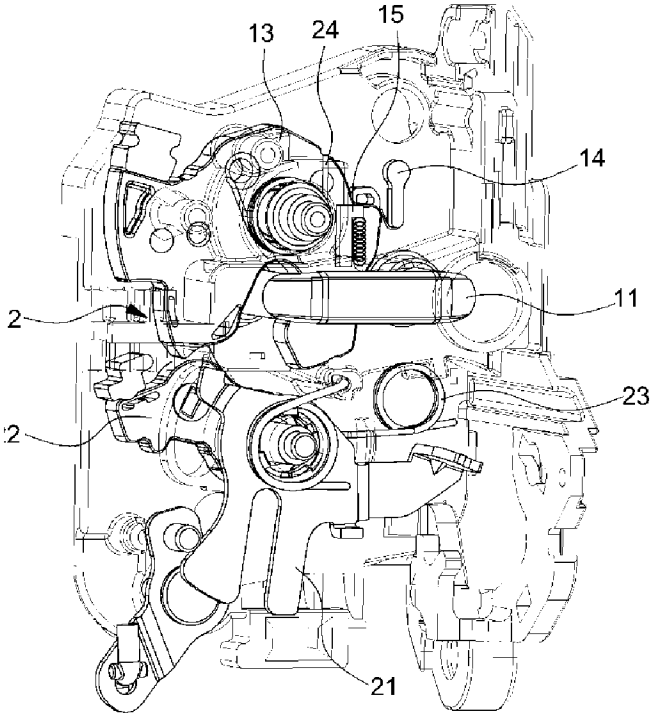
Figure 3A:
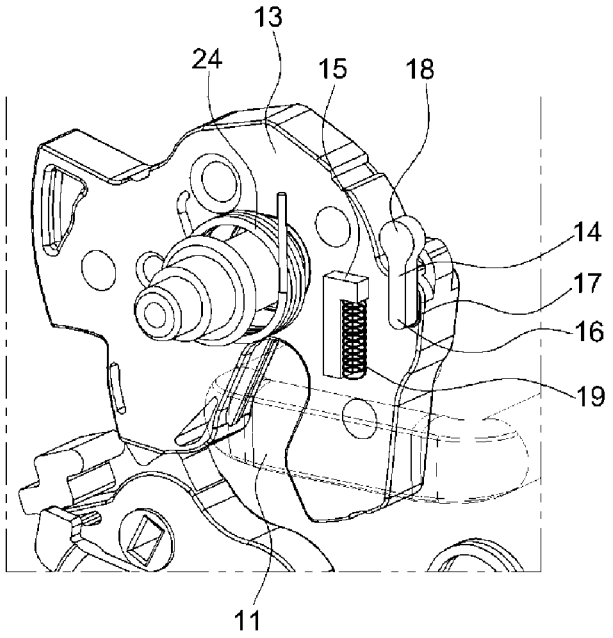
FIGS. 3A and 3B are back perspective views illustrating an operational relationship of a striker locking lever in the door opening prevention device according to an exemplary embodiment of the present invention.
Figure 3B:
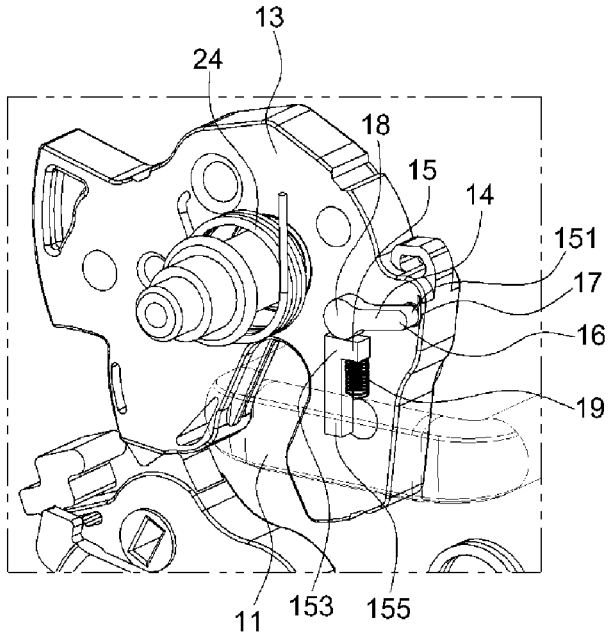

FIGS. 2A and 2B are back perspective views illustrating the door opening prevention device according to an exemplary embodiment of the present invention, and FIG. 3 is a back perspective view illustrating an operational relationship of a striker locking lever in the door opening prevention device according to an exemplary embodiment of the present invention.

As illustrated in FIGS. 2A, 2B, 3A and 3B, the door opening prevention device includes a balance weight 14 which is tilted by inertia in a broadside collision of a vehicle, and a striker locking lever 15 which is operated in conjunction with the balance weight 14, and jams the claw 13 and the striker 11.

The balance weight 14 is formed in a bar shape, and an upper end portion of the bar is formed as a mass portion 18 that is heavier than the remaining portion.

The balance weight 14 is installed to have a structure in which the balance weight 14 is rotatably supported by a hinge shaft 16 formed on one side surface (claw back surface portion) of the claw 13 through a lower end portion of the balance weight 14, in a vertical posture in which the heavy mass portion 18 is directed upward.

The balance weight 14, which is installed as described above, is positioned toward an interior room based on a claw rotation center axis such that the balance weight 14 may be tilted toward the exterior of the interior room by inertia in a broadside collision of a vehicle, and then may strike the striker locking lever 15.

Further, a return spring 17, which has an end caught by the claw 13, and the other end caught by the balance weight 14 side, is installed on the hinge shaft 16 to which the lower end portion of the balance weight 14 is fitted, and the return spring 17 serves to maintain the balance weight 14 in the vertical posture in a normal state when a broadside collision of a vehicle does not occur.

The striker locking lever 15 is a component that is tightly fitted between a side surface of the claw 13 and an inner surface of the striker 11 which is formed in a "ㄷ" shape, and serves to jam the claw 13 and the striker 11 together.

The striker locking lever 15 is formed in a bar shape having an approximately "ㄱ" shape, and is installed to have a structure in which the striker locking lever 15 is supported on the side surface of the claw 13 at a position between the rotation center axis of the claw 13 and the balance weight 14.

In this case, the striker locking lever 15 is in tight contact with the side surface of the claw 13, and may be moved in up and down directions while being guided by the side surface of the claw 13. The striker locking lever 15 is supported in a guide bracket 50, which may be installed on the side surface of the claw and has an approximately "ㄷ" shape, and may be slidingly guided by the guide bracket when the striker locking lever 15 is moved in the up and down directions.

Further, a lever spring 19, which has ends that are supported at the striker locking lever 15 and the claw 13, is provided, and the lever spring 19 is positioned under a protrusion 151 of the locking lever, which is bent horizontally, so as to resiliently support upward the striker locking lever 15.

A bar-shaped body of the striker locking lever 15 is formed in a tapered shape in which a cross-sectional area gradually becomes smaller from an upper end portion 153 to which the protrusion 151 is formed to a lower end portion 155, such that the striker locking lever 15 may be tightly fitted between the side surface of the claw and the inner surface of the striker by a wedge effect while the striker locking lever 15 is moved downward to be fitted between the side surface of the claw and the inner surface of the striker.

In addition, the weight balance 14 is not involved in jamming the striker 11, but is just involved in operating the striker locking lever 15, such that a sufficient weight of the weight balance 14 is just needed, and the weight balance 14 needs not to be made of a particularly strong material, but the striker locking lever 15 may be made of a strong material. For example, the weight balance may be made of plastic or the like, and the striker locking lever may be made of steel or the like.

Therefore, an operational state of the door opening prevention device, which is configured as described above, will be described below.

Figure 4A:
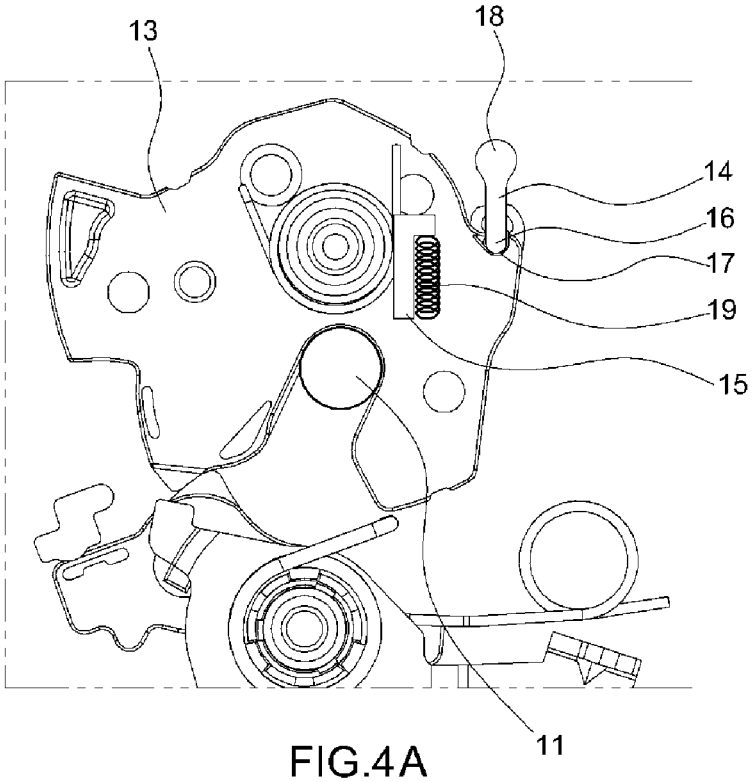
FIGS. 4A and 4B are back views illustrating an operational state of the door opening prevention device according to an exemplary embodiment of the present invention.
Figure 4B:
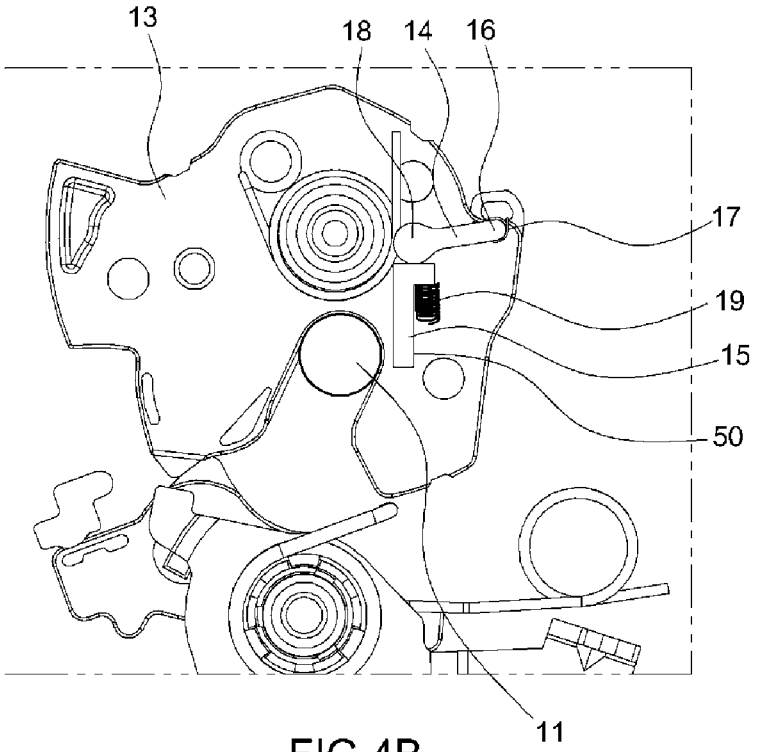
Figure 5:
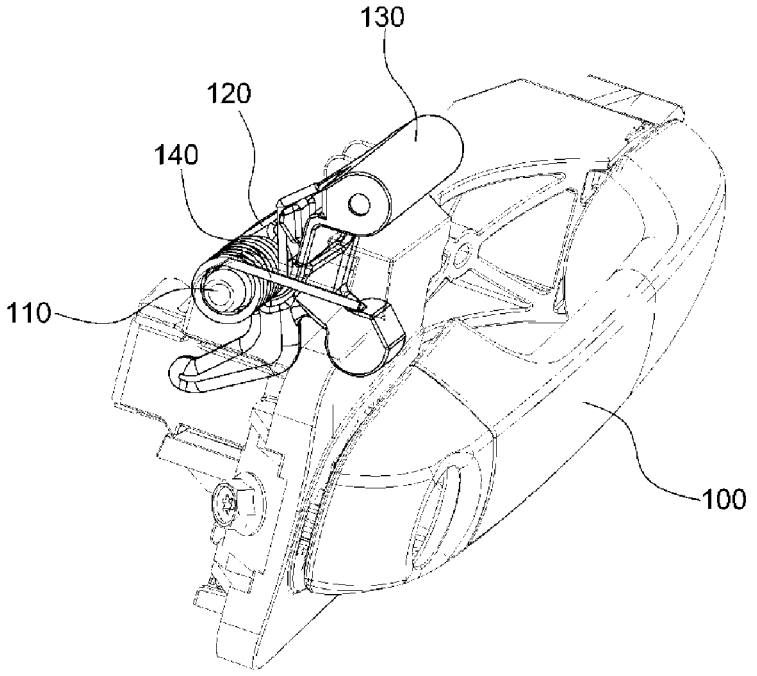
FIG. 5 is a perspective view illustrating a door outside handle and a balance weight in the related art.

FIGS. 4A and 4B are back views illustrating an operational state of the door opening prevention device according to an exemplary embodiment of the present invention.

As illustrated in FIGS. 4A and 4B, the door opening prevention device includes two inertia components (the balance weight and the striker locking lever) so as to be operated so as to restrict escape of the striker that determines the opening of the door, and uses a principle that the door is not opened if the striker does not escape even though other levers, which are involved in opening the door, are rotated.

That is, the door opening prevention device is operated so as to directly restrict the striker that finally determines the opening of the door, such that the door is not absolutely opened even though other levers, which are involved in opening the door, are rotated.

The two inertia components are configured as a mechanism by intersection of rectilinear motion and rotational motion, and may be operated in a manner in which the inertia components are tightly fitted between the striker side and the claw side so as to restrict motion of the striker which performs rectilinear motion instead of rotational motion.

Before a broadside collision of a vehicle, the striker locking lever 15 is positioned at a home position (a position where the striker locking lever 15 is not inserted into the striker) by force of the lever spring 19, and the balance weight 14 is also forced to be positioned at a home position (a position where the balance weight 14 stands right) by force of the return spring 17.

In this state, the striker 11 may escape from the claw 13 while tilting the claw 13 such that the user may normally open the door by operating the outside handle.

In a broadside collision of a vehicle, the balance weight 14 is instantaneously rotated toward a portion where the striker locking lever 15 is positioned, by inertial force that is applied to the balance weight 14, and simultaneously pushes the striker locking lever 15 through the mass portion 18, and the striker locking lever 15 is moved downward and tightly fitted between the side surface of the claw 13 and the inner surface of the striker 11, and jams the claw 13 and the striker 11.

Accordingly, the striker 11 is tightly fitted with the claw 13 so as not to be pulled, and as a result, the door is not opened.

As such, the present invention implements a technology in which the latch instead of the outside handle restricts the striker at the time of a collision, and thus a weight balance of the handle is omitted, thereby greatly reducing costs and weights.

In addition, because the weight balance of the handle needs to be tuned continuously whenever various types of vehicles are developed and in accordance with a tendency that the design of the handle also becomes various, costs for development and tests, and an M/H at the time of development are greatly consumed, but when the structure of the present invention is applied, since the door latch itself prevents the door from being opened at the time of a collision regardless of the door handle, the structure of the present invention may be commonly applied to the entire types of vehicles without additional development and tests once the structure of the present invention is developed, thereby reducing costs for tests, and reducing input of the M/H.

In addition, even when the design of the handle can be formed in any shape, the door is prevented from being opened, and thus a degree of design freedom is increased, thereby greatly improving marketability.

In addition, since the door is prevented from being opened regardless of the handle, the door is not opened even in various broadside collision modes that may occur at the time of actual traffic accidents.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A door opening prevention device in a broadside collision of a vehicle, having a latch assembly which locks and unlocks a door side striker in conjunction with an operation of an outside handle when the outside handle is operated, the door opening prevention device comprising:

a balance weight which is directly coupled to a side surface of a claw disposed in the latch assembly and rotatable with respect to the claw, wherein the balance weight is pivotable in a first direction by mass inertia of the balance weight generated in an event of the broadside collision of the vehicle; and a striker locking lever slidably mounted on the side surface of the claw, wherein the striker locking lever is elastically biased in a second direction opposite to the first direction and a contact of the striker locking lever with the balance weight occurs in the event of the broadside collision of the vehicle, wherein the striker locking lever is fitted between the side surface of the claw and the door side striker to jam the claw and the door side striker while being moved in the first direction by contact with the balance weight by the inertia in the broadside collision of the vehicle.

2. The door opening prevention device of claim 1, wherein the balance weight has a lower end which is rotatably supported by a hinge shaft that is formed on the side surface of the claw; and wherein the balance weight receives restoring force of a return spring which is installed on the hinge shaft and connects the side surface of the claw and the balance weight, to maintain a vertical posture.

3. The door opening prevention device of claim 1, wherein an upper portion of the balance weight is formed as a mass portion that is heavier than a remaining portion of the balance weight.

4. The door opening prevention device of claim 1, wherein the striker locking lever is resiliently supported upward by a lever spring that has an end supported at the side surface of the claw.

5. The door opening prevention device of claim 1, wherein the striker locking lever includes a lower end portion extending from an upper end portion of the striker locking lever in a tapered shape such that a cross-sectional area of the striker locking lever gradually becomes smaller from the upper end portion toward the lower end portion.

6. The door opening prevention device of claim 5, wherein the striker locking lever further includes a protrusion extending from the upper end portion, and wherein a lever spring that has an end supported at the side surface of the claw is positioned under the protrusion to elastically support the striker locking lever upwards.

7. The door opening prevention device of claim 1, further including a bracket to slidably receive the striker locking lever therein.

8. The door opening prevention device of claim 1, wherein an upper portion of the balance weight is formed as a mass portion that is heavier than a remaining portion of the balance weight, such that in the broadside collision of the vehicle, the balance weight is instantaneously rotated toward a portion where the striker locking lever is positioned, by inertial force that is applied to the balance weight, and simultaneously pushes the striker locking lever through the mass portion, and the striker locking lever is moved in the first direction and fitted between the side surface of the claw and the inner surface of the striker, and jams the claw and the striker.

9. The door opening prevention device of claim 1, wherein the striker locking lever slidably engaged to the side surface of the claw rectilinearly moves along the side surface of the claw.

* * * * *